US006129531A

United States Patent [19]

Elson et al.

[11] Patent Number: 6,129,531

[45] Date of Patent: Oct. 10, 2000

[54] OPEN DRIVE SCROLL MACHINE

[75] Inventors: John Paul Elson, Sidney; Natarajan Rajendran, Huber Heights; Todd Alan DeVore, Wapakoneta, all of Ohio

[73] Assignee: Copeland Corporation, Sidney, Ohio

[21] Appl. No.: 08/995,719

[22] Filed: Dec. 22, 1997

[51] Int. Cl.[7] ..... F04C 18/00

[52] U.S. Cl. ..... 418/55.6; 418/89; 418/88; 418/94

[58] Field of Search ..... 418/55.6, 89, 88, 418/94

[56] References Cited

U.S. PATENT DOCUMENTS

| | | | |
|---|---|---|---|
| 4,260,402 | 4/1981 | Shaffer et al. | 55/505 |
| 4,340,339 | 7/1982 | Hiraga et al. | 418/55 |
| 4,547,138 | 10/1985 | Mabe et al. | 418/55 |
| 4,551,081 | 11/1985 | Sato et al. | 418/55.1 |
| 4,648,814 | 3/1987 | Shiibayashi | 418/55 |
| 4,900,238 | 2/1990 | Shigemi et al. | 417/410 |
| 5,110,268 | 5/1992 | Sakurai et al. | 417/410 |
| 5,222,885 | 6/1993 | Cooksey | 418/96 |
| 5,330,335 | 7/1994 | Teracuhi et al. | 418/55.6 |
| 5,346,376 | 9/1994 | Bookbinder et al. | 418/55.4 |
| 5,358,392 | 10/1994 | Ukai | 418/55.6 |
| 5,391,066 | 2/1995 | Sawai et al. | 418/55.6 |
| 5,520,524 | 5/1996 | Takemoto et al. | 418/55.5 |
| 5,545,020 | 8/1996 | Fukanuma et al. | 418/55.4 |
| 5,580,228 | 12/1996 | Ishikawa et al. | 418/55.2 |
| 5,645,408 | 7/1997 | Fujio et al. | 418/55.6 |
| 5,678,986 | 10/1997 | Terauchi et al. | 418/55.6 |
| 5,807,089 | 9/1998 | Tsumagari et al. | 418/55.3 |

*Primary Examiner*—Thomas Denion
*Assistant Examiner*—Thai-Ba Trieu
*Attorney, Agent, or Firm*—Harness, Dickey & Pierce, P.L.C.

[57] ABSTRACT

An open drive scroll compressor had a unique lubrication system which includes a vane type oil pump attached to an outer diameter of the drive shaft of the compressor. The oil pump draws oil from an oil sump, sends a first portion of the oil to the components of the compressor needing lubrication and a second portion through a filter. The return to the sump from the filter is restricted to control oil pressure and thus the amount of circulated oil. The scroll compressor includes a first baffle between the oil sump and a counterweight attached to the drive shaft and a second baffle disposed between the scroll members and the oil sump.

23 Claims, 1 Drawing Sheet

OPEN DRIVE SCROLL MACHINE

FIELD OF THE INVENTION

The present invention relates to open drive scroll machines. More particularly, the present invention relates to scroll compressors which are exteriorly driven and which incorporate a unique lubrication system for the open drive scroll machine.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate scroll members having a pair of intermeshed spiral wraps, one of which is caused to orbit relative to the other so as to define one or more moving chambers which progressively decrease in size as they travel from an outer suction port toward a center discharge port. Some type of power unit is provided which operates to drive the orbiting scroll member via a suitable drive shaft. The bottom or lower portion of the housing which contains the scroll members normally contains an oil sump for lubrication of the various components of the compressor.

Scroll machines can be separated into two categories based upon the power unit which drives the scroll member. The first category is scroll machines which have the power unit located within the housing along with the scroll members. The housing containing the power unit and the scroll members can be open to the environment or it can be sealed to provide a hermetic scroll machine wherein the housing also contains the working fluid of the scroll machine. The second category of scroll machines is scroll machines which have the power unit separate from the housing containing the scroll members. These machines are called open drive scroll machines and the housing which contains the scroll members is normally sealed from the environment such that the housing also contains the working fluid of the scroll machine. The power unit for these open drive scroll machines can be provided by a drive belt and a pulley system, a gear drive system, a direct drive system or any other type of drive system.

The above categories of scroll machines can each be further subdivided into two additional categories of whether the scroll members are positioned vertically which is most common with the hermetic compressors or whether the scroll members are positioned horizontally which is most common with the open drive type of scroll machines. Both the vertical and horizontal positioned scroll members have unique problems which must be addressed relative to their lubrication system. Continued development of the scroll machines includes the continued development of the lubrication systems to address problems such as oil foaming, excessive oil ingestion by the scroll members and the need to continuously filter the lubrication oil to limit the amount of debris circulated through the working components of the scroll machine.

The present invention discloses a unique lubrication system for an open drive horizontal scroll machine which functions to control and optimize the flow of lubricating oil throughout the scroll machine. By controlling and optimizing the flow of lubricating oil, the unique lubrication system of the present invention increases the efficiency of the scroll machine by minimizing power draw related to the lubricating oil and its circulation through the scroll machine.

Other advantages and objects of the present invention will become apparent to those skilled in the art from the subsequent detailed description, appended claims and drawings.

BRIEF DESCRIPTION OF THE DRAWINGS

In the drawing which illustrates the best mode presently contemplated for carrying out the present invention.

DETAILED DESCRIPTION OF THE PREFERRED EMBODIMENT

Figure 1:
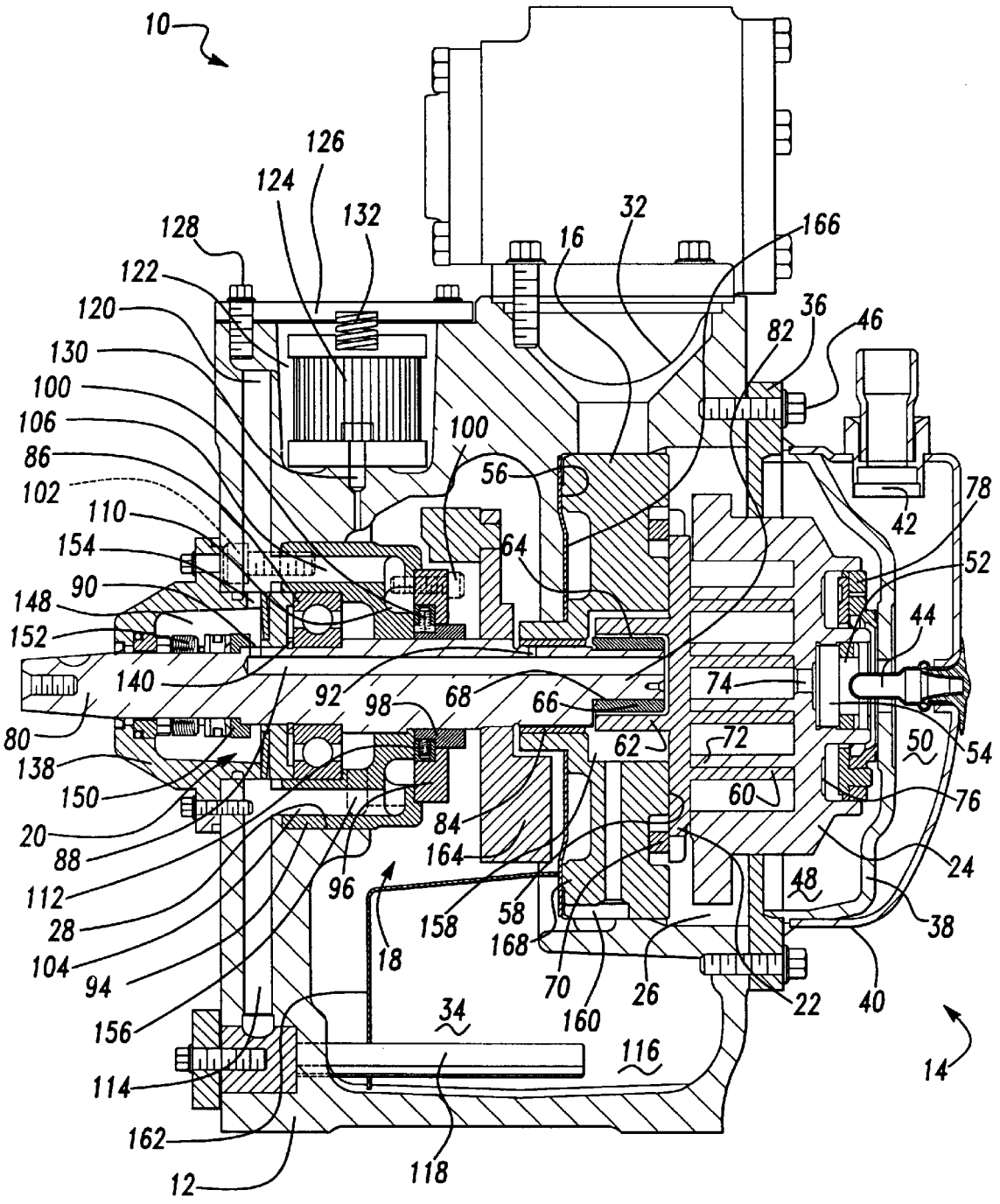
FIG. 1 is a vertical cross-section of an open drive horizontal scroll machine incorporating the unique lubrication system in accordance with the present invention.

Referring now to the drawing, there is shown in FIG. 1 an open drive horizontal scroll compressor which incorporates the unique lubrication system in accordance with the present invention which is designated generally by reference numeral 10. Compressor 10 comprises a compressor body 12, a cap assembly 14, a main bearing housing 16, an oil pump assembly 18, a lower bearing assembly 20, an orbiting scroll member 22 and a non-orbiting scroll member 24. Compressor body 12 is a generally cup shaped member, preferably made from aluminum defining an internal cavity 26 which mates with main bearing housing 16, an internal bore 28 for mating with oil pump assembly 18 and lower bearing assembly 20 and a suction inlet 32 for mating with the refrigeration circuit associated with compressor 10. Compressor body 12, cap assembly 14 and lower bearing assembly 20 define a sealed chamber 34 within which scroll members 22 and 24 are disposed.

Cap assembly 14 comprises an adaptor plate 36, a partition 38, a cap 40, a discharge fitting 42 and a temperature probe 44. Adaptor plate 36 is secured to compressor body 12 using a plurality of bolts 46. Partition 38 is welded about its periphery to adaptor plate 36 at the same point that cap 40 is welded to partition 38. Partition 38 separates chamber 34 into a suction zone 48 and a discharge zone 50. Discharge fitting 42 extends through cap 40 and provides a discharge gas outlet from discharge zone 50 to the refrigeration circuit associated with compressor 10. Temperature probe 44 extends through cap 40 and partition 38 such that it is located within a discharge recess 52 located within non-orbiting scroll member 24. A dynamic discharge valve assembly 54 is located within discharge recess 52 and is retained within recess 52 by a nut threadingly received within recess 52.

Main bearing housing 16 is press fit into cavity 26 of compressor body 12 and rests against a shoulder 56 formed by cavity 26. The surface of main bearing housing 16 opposite to shoulder 56 is provided with a flat thrust bearing surface 58 against which is located orbiting scroll member 22 which is manufactured from iron and which has a usual spiral vane or wrap 60. Projecting opposite to wrap 60 is a cylindrical hub 62 having a journal bearing 64 in which is rotatively disposed a drive bushing 66 having an inner bore 68. An Oldham coupling 70 is also provided positioned between orbiting scroll member 22 and bearing housing 16. Oldham coupling 70 is keyed to orbiting scroll member 22 and non-orbiting scroll member 24 to prevent rotational movement of orbiting scroll member 22. Oldham coupling 70 is preferably of the type disclosed in assignee's U.S. Pat. No. 5,320,506, the disclosure of which is hereby incorporated herein by reference.

Non-orbiting scroll member 24 is manufactured from iron and is also provided with a wrap 72 positioned in meshing engagement with wrap 60 of orbiting scroll member 22.

Non-orbiting scroll member 24 has a centrally disposed passage 74 which communicates with discharge recess 52 through discharge valve assembly 54 which is in turn in communication with discharge zone 50 defined by cap 40 and partition 38. An annular recess 76 is also formed in non-orbiting scroll member 24 within which is disposed a seal assembly 78. Recesses 52 and 76 and seal assembly 78 cooperate to define axial pressure biasing chambers which receive pressurized fluid being compressed by wraps 60 and 72 so as to exert an axial biasing force on non-orbiting scroll member 24 to thereby urge the tips of respective wraps 60 and 72 into sealing engagement with the opposed end plate surfaces. Seal assembly 78 is preferably of the type described in greater detail in U.S. Pat. No. 5,156,539, the disclosure of which is hereby incorporated herein by reference. Non-orbiting scroll member 24 is designed to be mounted to bearing housing 16 in a suitable manner such as disclosed in U.S. Pat. No. 4,877,382 or U.S. Pat. No. 5,102,316 both disclosures of which are hereby incorporated herein by reference.

A steel drive shaft or crankshaft 80 having an eccentric crank pin 82 at one end thereof is rotatably journalled in a sleeve bearing 84 in main bearing housing 16 and a roller bearing 86 in lower bearing assembly 20. Crank pin 82 is drivingly disposed within inner bore 68 of drive bushing 66. Crank pin 82 has a flat on one surface which drivingly engages a flat surface (not shown) formed in a portion of bore 68 to provide a radially compliant drive arrangement, such as shown in assignee's aforementioned U.S. Pat. No. 4,877,382. Crankshaft 80 includes an axially extending bore 88 which intersects with a radial inlet bore 90 and a radial outlet bore 92 as will be described later herein. The end of crankshaft 80 opposite to crank pin 82 extends through lower bearing assembly 20 and is adapted to be connected to the power unit being used to drive drive shaft 80.

Oil pump assembly 18 is disposed within chamber 34 in concentric relationship to drive shaft 80. Oil pump assembly 18 comprises a housing 94, a pump body 96, a drive member 98 and a plurality of vanes 100. Housing 94 is secured to compressor body 12 using a plurality of bolts 102. Housing 94 defines an oil inlet passage 104 and an oil outlet passage 106. Pump body 96 is secured to housing 94 using a plurality of bolts 108 and thus pump body 96 is stationary. Pump body 96 defines a pumping chamber 110 within which the plurality of vanes 100 are located. Drive member 98 is drivingly secured to drive shaft 80 such that rotation of drive shaft 80 causes rotation of drive member 98. Vanes 100, four in the preferred embodiment, are disposed within chamber 110 and within pockets 112 located within drive member 98. Rotation of drive shaft 80 causes rotation of drive member 98 which in turn cause rotation of vanes 100 in pumping chamber 110 and the pumping of oil between inlet passage 104 which is in communication with a supply passage 114 which extends through compressor body 12 and which is in communication with an oil sump 116 located within sealed chamber 34 through a filter 118. Outlet passage 106 is in communication with a supply passage 120 which extends through compressor body 12 and is in communication with a filter chamber 122 formed by compressor body 12. An oil filter 124 is disposed within chamber 122 and chamber 122 is closed by a filter cap 126 which is secure to compressor body 12 using a plurality of bolts 128. Oil filter 124 is located between supply passage 120 and a return passage 130 which leads back to oil sump 116. A spring 132 biases oil filter 124 away from filter cap 126 to ensure oil flows through filter 124 before entering return passage 130. Return passage 130 is a stepped diameter passage which restricts oil flow to increase the oil pressure thereby providing oil to the moving components of compressor 10 as detailed below. The restricting of return passage 130 operates to control the amount of oil which is circulated through compressor 10. The amount of circulated oil is critical to the overall operation of compressor 10. Thus, oil pump assembly 18 pumps oil form oil sump 116 through supply passage 114, through inlet passage 104, through pumping chamber 110, out through outlet passage 106, through supply passage 120 and into filter chamber 122. From filter chamber 122 oil passes through oil filter 124 and back to oil sump 116 through return passage 130 with oil filter 124 removing debris from within the oil. Oil filter 124 can easily be changed by removing bolts 128 and cap 126 to gain access to oil filter 124.

Lower bearing assembly 20 comprises roller bearing 86 and a bearing cover 138. Roller bearing 86 is disposed between drive shaft 80 and housing 94 of oil pump assembly 18. A snap ring 140 positions the inner race of bearing 86 while the outer race is retained by bearing cover 138. Bearing cover 138 is secured to compressor body 12 using a plurality of bolts 142. A bearing spacer 144 and a Belville spring 146 are positioned between cover 138 and the outer race of bearing 136 to properly locate bearing 136. Bearing cover 138 defines an internal bore 148 having a plurality of circumferentially spaced radially inwardly extending ribs which position a spacer 150 and a plurality of seals 152 disposed between drive shaft 80 and bearing cover 138. Bearing cover 138 defines a radially extending oil passage 154 which places internal bore 148 in fluid communication with supply passage 120 in compressor body 12. In addition, inlet bore 90 of crankshaft 80 is in fluid communication with internal bore 148. Thus, in addition to oil pump assembly 18 supplying oil to filter chamber 122 through supply passage 120, a portion of the oil in supply passage 120 is directed through passage 154 and into internal bore 148 to lubricate seals 152 as well as bearing 86. A return passage 156 is provided in housing 94 of oil pump assembly 18 to return oil from bearing 136 to oil sump 116. A portion of the oil which is delivered to internal bore 148 enters inlet bore 90 in drive shaft 80, into axial extending bore 88 and out outlet bore 92 as well as out the axial end of drive shaft 80 through bore 88. The fluid which is directed out of outlet bore 92 lubricates bearing 84 in bearing housing 16 and the fluid exiting the end of bore 88 lubricates journal bearing 64 and drive bushing 66 located within cylindrical hub 62. The oil which lubricates bearing 84 as well as the oil that lubricates bearing 64 and bushing 66 returns to oil sump 116 by being directed to a chamber 158 formed by main bearing housing 16. Chamber 158 is in communication with oil sump 116 through a return passage 160 located within bearing housing 16.

Thus, oil pump assembly 18 which is located centrally with respect to drive shaft 80 pumps oil to all functional area of compressor 10 as well as through a filtering system to continuously remove contaminates and debris from the cooling oil. Oil pump assembly 18 removes oil from sump 116 and distributes it throughout compressor 10. A first baffle 162 is located within oil sump 116 and operates to isolate oil sump 116 from the remainder of internal cavity 26, to isolate oil sump 116 from the rotational motion of a counterweight 164 secured to drive shaft 80 to isolate counterweight 164 and from the highly masted oil from being returned to sump 116. By isolating oil sump 116 in this manner, oil stirring and foaming of the oil is significantly reduced. The reduction in oil stirring and reduction in foaming of the oil permits counter weight 164 to rotate freely within internal cavity 26 and reduces the power requirement for compressor 10 by as much as 10%. A second baffle 166 is located between main bearing housing 16 and shoulder 56 of compressor body 12. Baffle 166 isolates the portion of internal cavity 26 which houses scroll members 22 and 24 and main bearing housing 16 from the portion of internal cavity 26 which houses oil sump 116. The separation of these two portions of internal cavity 26 significantly reduces the oil integration in the suction port of scroll members 22 and 24 again increasing the operating efficiency of compressor 10. A vent hole 168 extends through baffle 166 to equalize the pressure in both portions of cavity 26 as well as providing an oil drain.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a compressor body defining a chamber and an internal cavity;

a first scroll member disposed within said internal cavity; said first scroll member having a first spiral wrap;

a second scroll member disposed within said internal cavity, said second scroll member having a second spiral wrap intermeshed with said first spiral wrap;

a drive shaft rotatably supported with respect to said compressor body, said drive shaft receiving rational input and transferring said rotational input to one of said scroll members for causing said scroll members to orbit relative to one another whereby said spiral wraps will create pockets of progressively changing volume between a suction pressure zone of said internal cavity and a discharge pressure zone of said internal cavity;

an oil distribution system disposed with said chamber and said internal cavity, said oil distribution system comprising:

an oil sump disposed within said suction pressure zone of said internal cavity; and an oil pump attached to an outer surface of said drive shaft, said oil pump being powered by said driveshaft to pump oil from said oil sump, to components of said scroll machine requiring lubrication.

2. The scroll machine according to claim 1 wherein, said compressor body defines a first oil passage between said oil sump and said oil pump, a second oil passage between said oil pump and an oil filter and a third oil passage between said first oil filter and said oil sump.

3. The scroll machine according to claim 2 wherein, said third oil passage is stepped to restrict oil flow.

4. The scroll machine according to claim 1 wherein, said drive shaft defines a bore, said oil pump supplying oil to said bore in said drive shaft.

5. The scroll machine according to claim 1 further comprising a counterweight attached to said drive shaft and a first baffle disposed between said counterweight and said oil sump.

6. The scroll machine according to claim 5 further comprising a second baffle separating said internal cavity into a first portion containing said first and second scrolls and a second portion containing said oil sump.

7. The scroll machine according to claim 6 wherein, said second baffle defines a vent hole for equalizing pressure in said first and second portions of said internal cavity.

8. The scroll machine according to claim 1 further comprising a baffle separating said internal cavity into a first portion containing said first and second scrolls and a second portion containing said oil sump.

9. The scroll machine according to claim 8 wherein, said baffle defines a vent hole for equalizing pressure in said first and second portions of said internal cavity.

10. The scroll machine according to claim 1 wherein, said oil pump is a vane pump.

11. The scroll machine according to claim 1 wherein, said oil distribution system further comprises a first oil filter disposed within said chamber and a first filter cap secured to said compressor body, said first filter cap allowing removal of said first oil filter from said chamber.

12. The scroll machine according to claim 11 wherein, said first oil filter is a removable cartridge oil filter.

13. The scroll machine according to claim 11 wherein, said oil distribution system further comprises a second oil filter disposed within said oil sump and a second filter cap, said second filter cap allowing removal of said second oil filter from said sump.

14. The scroll machine according to claim 1 wherein, said drive shaft is rotatably supported by a roller bearing and a sleeve bearing.

15. The scroll machine according to claim 1 wherein, said compressor body is aluminum.

16. A scroll machine comprising:

a compressor body defining an internal cavity;

a first scroll member disposed within said internal cavity, said first scroll member having a first spiral wrap;

a second scroll member disposed within said internal cavity, said second scroll member having a second spiral wrap intermeshed with said first spiral wrap;

a drive shaft rotatably supported with respect to said compressor body, said drive shaft receiving rotational input and transferring said rotational input to one of said scroll members for causing said scroll members to orbit relative to one another whereby said spiral wraps will create pockets of progressively changing volume between a suction pressure zone of said internal cavity and a discharge pressure zone of said internal cavity;

an oil sump disposed within said suction pressure zone of said internal cavity;

a first battle separating said suction pressure zone of said internal cavity into a first portion containing said first and second scrolls and a second portion containing said oil sump; and an oil pump attached to an outer surface of said drive shaft, said oil pump being powered by said drive shaft to pump oil to components of said scroll machine requiring lubrication.

17. The scroll machine according to claim 16 wherein, said first baffle defines a vent hole for equalizing pressure in said first and second portions of said internal cavity.

18. The scroll machine according to claim 16 further comprising a counterweight attached to said drive shaft and a second baffle disposed between said counterweight and said oil sump.

19. The scroll machine according to claim 16 wherein, said oil pump is disposed within said second portion of said cavity.

20. The scroll machine according to claim 19 further comprising a first oil filter disposed within a filter chamber defined by said compressor body and a first filter cap secured to said compressor body, said first filter cap allowing removal of said first oil filter from said filter chamber.

21. The scroll machine according to claim 20 wherein, said first oil filter is a removable cartridge oil filter.

22. The scroll machine according to claim 20 further comprising a second oil filter disposed within said oil sump and a second filter cap secured to said compressor body, said second filter cap allowing removal of said second oil filter from said oil sump.

23. The scroll machine according to claim 19 wherein, said oil pump is a vane pump.

* * * * *

UNITED STATES PATENT AND TRADEMARK OFFICE

CERTIFICATE OF CORRECTION

PATENT NO. : 6,129,531
DATED : October 10, 2000
INVENTOR(S) : John P. Elson et al

It is certified that error appears in the above-identified patent and that said Letters Patent is hereby corrected as shown below:

Column 4, line 5, "form" should be -- from --.

Column 5, line 23, "rational" should be -- rotational --.

Column 6, line 35, "battle" should be -- baffle --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,129,531
DATED : October 10, 2000
INVENTOR(S) : John Paul Elson et al.

It is certified that error appears in the above-identified patent and that said Letters Patent is hereby corrected as shown below:

Title Page,
Item [75], Inventors, add -- Eric G. Keifer --.

Signed and Sealed this

Ninth Day of July, 2002

*Attest:*

*Attesting Officer*

JAMES E. ROGAN
*Director of the United States Patent and Trademark Office*